United States Patent [19]

Davis

[11] 4,396,401

[45] Aug. 2, 1983

[54] POKING SYSTEM FOR GASIFIERS

[75] Inventor: Roderick M. Davis, Pedmore, England

[73] Assignee: Wellman Mechanical Engineering Limited, Warley, England

[21] Appl. No.: 288,126

[22] Filed: Jul. 29, 1981

[30] Foreign Application Priority Data

Aug. 2, 1980 [GB] United Kingdom ..... 8025401

[51] Int. Cl.[3] ..... C10J 3/72

[52] U.S. Cl. ..... 48/85.2; 48/87; 48/149; 48/99; 48/235; 48/70; 48/6

[58] Field of Search ..... 48/85.2, 87; 202/265; 432/98; 266/99, 235, 177, 131, 133; 246/201; 173/53, 54, 55, 149; 73/343 R, 295; 299/70

[56] References Cited

U.S. PATENT DOCUMENTS

| | | | |
|---|---|---|---|
| 1,323,991 | 12/1919 | Moore et al. | 246/201 |
| 3,399,735 | 9/1968 | Ikeda | 173/149 |
| 3,628,463 | 12/1971 | Kwiatkowski et al. | 246/201 |
| 4,134,738 | 1/1979 | Bress et al. | 48/87 |

FOREIGN PATENT DOCUMENTS

| | | | |
|---|---|---|---|
| 543002 | 2/1932 | Fed. Rep. of Germany | 48/85.2 |
| 2340104 | 2/1975 | Fed. Rep. of Germany | 266/233 |

*Primary Examiner*—William F. Smith

*Attorney, Agent, or Firm*—C. O. Marshall, Jr.

[57] ABSTRACT

A poking system for use in checking the condition of and agitating the contents of a coal gasifier utilizes a carriage (22) for transporting a poker (50) around the gasifier from one poke hole (12) to another. The carriage (22) mounts a poker assembly (24) comprising a tiltable arm (30) controlled by hydraulic ram (36) and the poker is incrementally inserted into and with withdrawn from each pokehole (12) by means of a reciprocable slide (38) provide with poker engaging clamps (60) which are operated during the advance or return stroke of the slide (38) depending on whether the poker is to be inserted or withdrawn. A pyrometer (72) is provided on the arm (30) for detecting, during withdrawal, the location of that portion of the poker (50) which has been resident within the oxidation zone of the gasifier.

9 Claims, 7 Drawing Figures

POKING SYSTEM FOR GASIFIERS

DESCRIPTION

This invention relates to a poking system for use in checking the condition of and, where necessary, agitating the contents of a coal gasifier. The invention has particular application to the well known two-stage, fixed bed coal gasifier in which coal is fed into the upper distillation zone of the gasifier and a steam/air blast is generated at the lower gasification zone to create an oxidation zone where part of the coal is burnt to generate the necessary heat for production of producer gas and distillation of volatiles in the distillation zone.

For optimum operation of such gasifiers, it is important to maintain the oxidation zone or coal bed within certain limits which can be controlled by regulating the rate of ash removal from the bottom of the gasifier. The gasifier may for example have a rotary grate whose speed of rotation determines the rate of ash removal. Historically, monitoring of the oxidation zone level was carried out manually by periodically inserting a poker a known distance through a series of poke holes located around the perimeter of the gasifier so that the poker passed through the oxidation zone. The poker was then withdrawn after several minutes and inspected to determine the position of that part of the poker which had been within the oxidation zone, which part could be discerned easily by its discolouration. In addition to its use for checking the oxidation zone level, the poker was also used to sense increased coal bed resistance due to the formation of clinker, the poker then being used to break down the clinker with a prodding action.

Interest in coal gasification was at its height from the 1930's to the 1950's but waned considerably in the 1950's when oil and natural gas supplies became plentiful. With the advent of the oil crisis however interest has been renewed in the 1970's and 1908's. While much of the gasification technology is just as applicable nowadays as it was in the past, the traditional manual method of poking is considered unsatisfactory in view of the adverse working conditions present in the immediate surroundings of the gasifier and the high labour costs now prevailing. This has led to consideration of automatic poking systems and one proposal in this direction is disclosed in U.S. Pat. No. 4,134,738.

In this patent, coal bed monitoring and agitation is effected by means of a number of pokerod assemblies provided about the periphery of the gasifier. Each such assembly comprises a cylindrical mounting tube which is built into the gasifier structure and a specially designed reciprocable pokerod which passes through seals at each end of the mounting tube and into the gasifier so that the pokerod can be extended until its inner end contacts the grate and subsequently retracted. Displacement of the pokerod is effected either by a hydraulic cylinder (the piston of which is coupled to the outer end of the pokerod) or by a motor operated rack and pinion drive. The poke rod is of hollow construction and a series of thermocouples are located within its hollow interior so that when the pokerod is fully extended into the gasifier temperature measurements can be obtained from the thermocouples to give a temperature profile of the coal bed.

This proposal suffers from a number of drawbacks. For example, it is necessary to provide a pokerod assembly at each poking site around the gasifier; the gasifier structure has to be modified to incorporate the mounting tubes; the pokerods are not readily removable to enable them to be straightened when, due to high temperatures involved, they become distorted; the thermocouples will require frequent renewal because under the prevailing high temperature conditions they will have a short working life and their renewal will be time consuming and expensive as they are encapsulated within the pokerod structure; and, where a hydraulic cylinder is used to reciprocate each pokerod, the cylinder has to have a large stroke to move the pokerod between its retracted and extended positions and inevitably the cylinder will be expensive to manufacture.

The object of the present invention is to provide an improved poking system which overcomes at least some and preferably all of the above mentioned drawbacks of the system proposed in U.S. Pat. No. 4,134,738.

According to one aspect of the present invention we provide a poking system for a coal gasifier having a plurality of poke holes disposed about its periphery, characterised by at least one carriage provided with means for mounting and reciprocating a poker, the or each carriage being mounted for movement about the gasifier to bring the poker carried thereby into registry with a selected poke hole to enable a poking operation to be performed by actuation of said poker reciprocating means.

The or each carriage is conveniently mounted on a track extending around the gasifier with means being provided on the carriage for driving it along the track from one poke hole to another. Means is preferably provided to detect arrival of the carriage in a predetermined position with respect to each of the set of poke holes to be serviced by the carriage, the carriage drive means being disabled upon such detection. The or each carriage may have associated with it a device for holding the carriage stationary when located in a said predetermined position and such device may comprise a clamping device mounted on the carriage and operable to engage the track in clamp fashion.

It is not essential for the carriage to be mounted on a track as such. It may for example be mounted on wheels and supported on a platform at a level suitable for registry of the poker with the pokeholes and it may be equipped with an operator controllable steering and drive arrangement and/or some form of docking means for holding the carriage stationary adjacent each pokehole while the poking operation is being carried out.

In practice, a single gasifier with say eight poke holes may be serviced by one or two carriages which may be controlled automatically according to a control programme such that the poking operations are executed in a predetermined sequence. In some circumstances, more than one gasifier may be serviced by the same poker-carrying carriage, suitable means conveniently being provided to transfer the carriage from one gasifier to the next.

According to a second aspect of the present invention we provide a poking system for a coal gasifier, comprising an assembly for mounting and reciprocating a poker, characterised in that said assembly includes a reciprocating device, and means for coupling the poker to said device during a forward stroke of the latter and disconnecting the poker from said device during the return stroke thereof in order to extend the poker incrementally into the gasifier, and vice versa in order to retract the poker incrementally from the gasifier.

Conveniently means is provided for holding the poker against movement when not coupled to said reciprocating device.

The coupling means may be selectively operable to couple the poker to the reciprocating device on both strokes thereof in certain circumstances, particularly when a prodding action is required in order to breakdown any clinker formation resisting entry of the poker into the gasifier.

Conveniently the reciprocating device has sensing means associated with it to sense the position of the device during at least those strokes in which the poker is coupled to said reciprocating device whereby the position of the poker during advance or withdrawal thereof can be monitored.

In one embodiment of the invention, the assembly comprises an arm mounting a slide for lengthwise reciprocation by a fluid powered piston and cylinder device, the slide being provided with a first selectively operable clamping device and the arm being provided with a second selectively operable clamping device, said first and second clamping devices being operated alternately by control means such that the first device, when operable, couples the poker to the slide for reciprocation therewith and the second device, when operable, holds the poker stationary with respect to the arm.

Preferably the arrangement is such that the coupling means and the holding means (constituted respectively by the first and second clamping devices in said one embodiment) can be released at the same time and are so designed that, when so released, the poker is free to be withdrawn from the assembly, e.g. for the purpose of replacement.

According to a preferred feature of the invention advance and withdrawal of the poker is effected by means of a fluid powered piston and cylinder device and to allow monitoring of the coal bed resistance encountered by the poker the fluid circuit for said device conveniently includes a pressure sensor to provide a measure of the force applied to the poker via the piston and cylinder. When the force sensed exceeds a predetermined value, the poker may be reciprocated as previously mentioned to provide a prodding action and conveniently the position about which the oscillatory movement takes place is advanced progressively to effect breaking down of any clinker formation.

In the preferred embodiment the mounting and reciprocating assembly for the poker is conveniently provided on a mobile carriage in accordance with the first mentioned aspect of the invention, the mounting arm being connected pivotally to the carriage and being supported by an adjustable device such as a fluid powered piston and cylinder to enable the inclination of the arm and hence the poker to be varied.

Means may also be provided for displacing the arm and hence the poker translationally with respect to the carriage to enable the poker to be shifted radially inwardly or outwardly of the gasifier and thereby compensate for any lack of concentricity between the path of travel of the carriage and the poke holes.

According to a further aspect of the present invention we provide a poking system for a gasifier comprising means for effecting advance and retraction of a poker into and out of the gasifier and means for sensing the position of the poker with respect to a datum position at least during withdrawal of the poker, characterised by a temperature sensor disposed externally of the gasifier adjacent the path of travel of the poker.

With this arrangement, during withdrawal of the poker from the gasifier, it is possible to locate transition points on the poker corresponding to the lower and/or upper limits of the oxidation zone and with the aid of the position sensing means, these transition points can be translated into measurements of the level of the oxidation zone.

Conveniently the temperature sensor is constituted by a pyroelectric device (preferably a total radiation pyrometer) providing an electrical output representing the radiation sensed. The pyrometer may be used in conjunction with a threshold detector to determine whether the electrical output of the pyrometer is above or below a predetermined value corresponding to a radiation level emitted by that portion of the poker which has been exposed to and has approached thermal equilibrium with the oxidation zone of the gasifier.

In order to promote further understanding of the invention, one embodiment thereof will now be described by way of example with reference to the accompanying drawings, in which.

Figure 1:
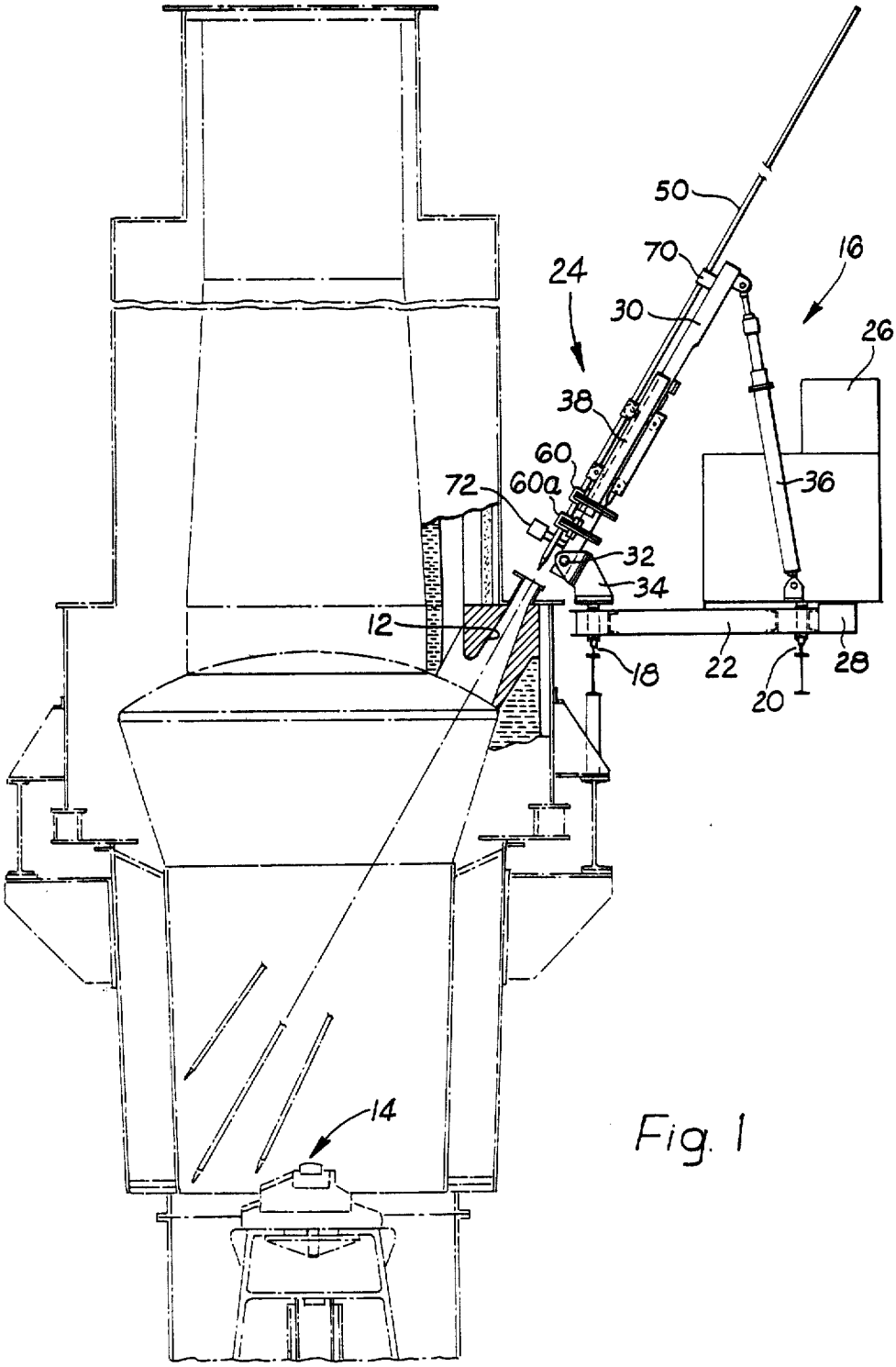
FIG. 1 is an elevation showing a two-stage, fixed bed gasifier provided with a poking system in accordance with the invention.

Referring now to the drawings, there is shown a two-stage, fixed bed gasifier which may be of conventional form and need not therefore be described in detail here as the construction and operation of two-stage gasifiers is well known in the art. For present purposes, it will suffice to point out that the gasifier is provided with a number (typically 8) poke holes 12 in equispaced relation around its circumference, each poke hole 12 being orientated so that its axis is directed downwardly towards the rotatable grate structure 14 of the gasifier. Each poke hole 12 may have a pivoted flap or the like (not shown) at its outer end which is movable between an open position to allow entry of a poker and a closed position to prevent escape of gases.

A mobile carriage 16 is mounted at substantially the same level as the poke holes 12 on a pair of concentric rails 18,20 which define a circular track extending around the gasifier in concentric relation therewith. The carriage comprises a wheeled base 22 which mounts a poker assembly 24 and a hydraulic power pack 26. The pack 26 applies oil under pressure to various actuators of the assembly including a hydraulic motor 28 which rotatably drives the drive wheels of the carriage to advance the carriage from one poke hole to another. The motor 28 may be reversible so that the carriage can be driven in either direction. A clamping device (not shown) cooperable with the inner rail 18 is mounted on the carriage and may be operable hydraulically to engage the inner rail in clamp fashion in order to hold the carriage stationary when it has been brought to rest adjacent a selected poke hole.

The carriage mounts a poker carrying structure comprising an arm 30 which at its lower end is mounted for tilting movement about a generally horizontal axis by means of a pivot pin 32 supported by a bracket 34 which may be rigidly connected to the carriage. If desired, the bracket 34 may include a swivel joint, e.g. at 35 (see FIG. 2) to enable the poker to be swivelled about an axis perpendicular to the pivot 32. Adjacent its upper end the arm 30 is connected pivotally to a double acting fluid powered piston and cylinder device 36 the opposite end of which is connected to the carriage base so that the arm is tilted in a generally vertical plane about pivot 32 in response to extension and retraction of the device 36.

Figure 2:
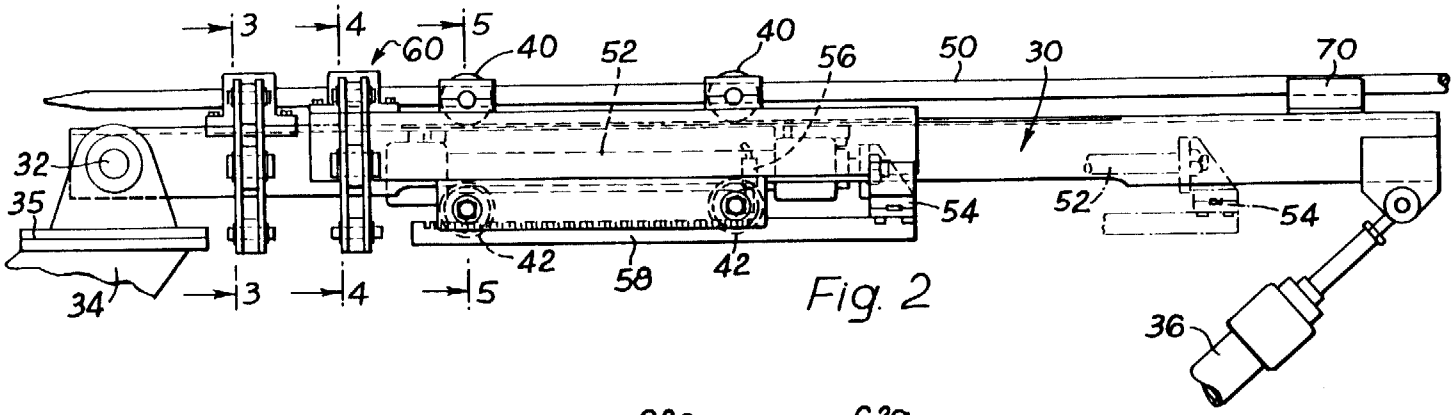
FIG. 2 is an enlarged side view of the poker mounting structure.
Figure 3:
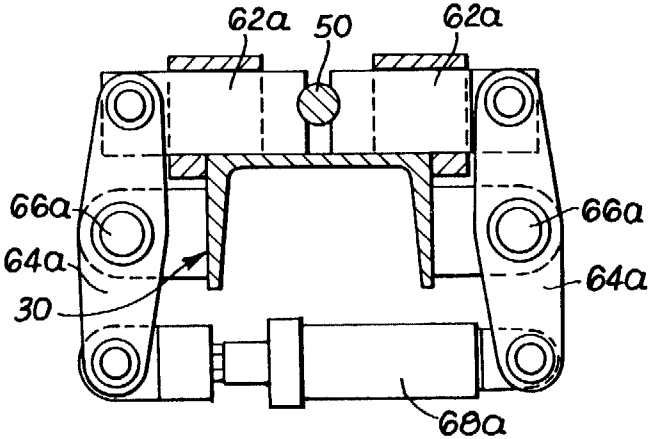
FIG. 3 is a sectional view seen in the direction 3—3 in FIG. 2.

The arm 30 mounts a slide 38 for reciprocation lengthwise of the arm, the slide being provided with rollers 40, 42. As illustrated, the arm 30 is of channel-section and the rollers 40 engage tracks formed on the exterior face of its base and the rollers 42 engage the free edges of its side walls. The slide 38 is also of channel section with depending side walls 44 having plates 46 secured thereto which rotatably mount the rollers 42. Gaps 48 are provided between the pairs of rollers 40 for reception of the poker 50. Reciprocation of the slide 38 is effected by a double acting fluid powered piston and cylinder device 52 which is located within the channel section of the arm 30 with one end anchored to the arm 30 and with its other end connected to the slide 38 via a cross piece 54 bridging the side walls 44 of the slide 38. It will be seen that extension and retraction of the device 52 is effected to move the slide 38 respectively away from and towards the lower end of the arm. In FIG. 2, the extended position of the device 52 is shown in broken outline.

The device 52 is arranged so that the stroke of each reciprocation imparted to the slide 38 is constant. In order to provide an indication of the position of the slide 38 at any instant, sensing means is provided which, in the illustrated embodiment, comprises an electromagnetic pick-up 56 mounted on the underside of the arm 30 for cooperation with a toothed or casetellated metal bar 58 mounted on the slide 58 so as to extend parallel to the direction of reciprocation. The teeth on the bar 58 are uniformly spaced in the lengthwise direction and the arrangement is such that, during each stroke of the slide 38 the pickup senses the successive teeth and provide electrical signals in pulse form so that each pulse corresponds to movement of the slide 38 through a known distance. Thus for example there may be one hundred teeth so that during one complete stroke, e.g. forward stroke, of the slide 38 one hundred pulses are generated, each pulse corresponding to one hundredth part of the stroke. The pulses may be fed to a counter in control equipment associated with the poking system.

In order to detect resistance to insertion of the poker into the coal bed, means is provided to sense the force exerted on the poker during insertion. As will become apparent, the device 52 is instrumental in effecting displacement of the poker and in one convenient embodiment, the force sensing means is constituted by a fluid pressure sensor 53 incorporated in the fluid supply circuit to the device 52 so as to provide a measure of the force that has to be exerted by the latter to overcome the coal bed resistance.

Figure 4:
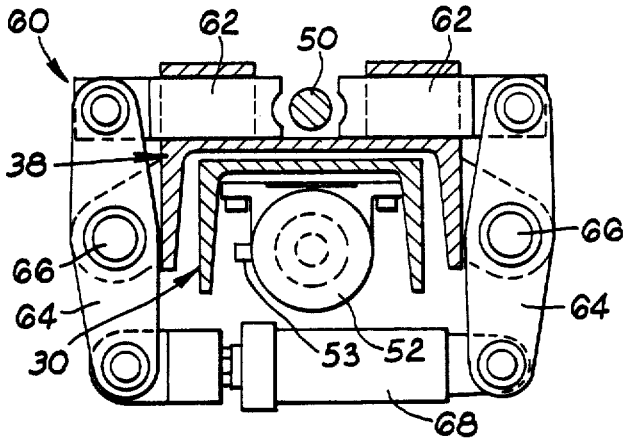
FIG. 4 is a sectional view seen in the direction 4—4 in FIG. 2.
Figure 5:
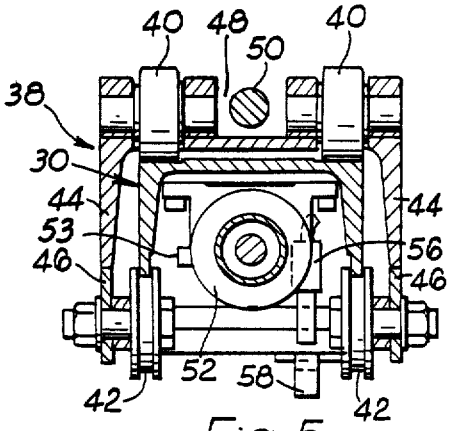
FIG. 5 is a sectional view seen in the direction 5—5 in FIG. 2.

To effect advance or retraction of the poker into or from the gasifier, the slide 38 is provided with a clamping device 60 which, in the illustrated embodiment (see FIG. 4 especially,) comprises a pair of jaws 62 slidable transversely of the slide 38 under the control of levers 64 which are pivoted to the side 38 at 66 and, at their lower ends, are coupled together by a double acting piston and cylinder device 68 so that when the device 68 is extended and retracted the jaws 62 respectively move towards each other (and hence grip the poker) and away from each other to release the poker. Thus when the clamping device 60 is operative the poker 50 is coupled for reciprocation with the slide 38.

A similar clamping device **60*a* is provided on the arm 30 for the purpose of preventing movement of the poker 50 when necessary. The clamping device 60*a* is similar in construction to the clamp 60 and like components therefore are indicated by the same reference numerals with the addition of suffix a. Operation of the clamping devices 60 and 60*a* is coordinated in such a way that they operate alternately as will be explained further hereinafter. Adjacent its upper end, the arm 30 is provided with a saddle 70 for support of the poker 50 so that, at any instant, the poker is supported on the arm 30 at least by the saddle 70 and one or other of the clamping devices 60 and 60*a***.

A temperature sensor 72 is mounted on the arm 30 adjacent its lower end for cooperation with the poker 50. The sensor is preferably in the form of a total radiation pyrometer which provides an electrical output related to the radiation falling on its radiation sensitive surface which may extend arcuately about the path of travel of the poker. The electrical output from the pyrometer is fed to the control equipment of the poking system. In practice, the pyrometer 72 is used to sense that portion of the poker which has been resident within the oxidation zone of the gasifier and in effect therefore the pyrometer is used to detect the transition point on the poker between the portion which has been in the oxidation zone and those portions which have been above and below the oxidation zone. Such transition points are in general fairly well defined in that at these points there is a reasonably abrupt change in the radiation emitted by the poker. Thus, while it is conceivable that the pyrometer 72 together with the associated control equipment could be used to record the temperature profile within the coal bed, in practice it is envisaged that such information will not be required and that to detect the transition points, the pyrometer may be used in conjunction with some form of threshold detector to detect whether or not the pyrometer output is above a certain preselected level and, in this event, the pyrometer is not used to provide actual measurements of radiation or temperature. Also, in practice, it may only be necessary to determine the position of the lower limit of the oxidation zone, i.e. the transition point between the oxidation zone and the ash bed, in which case the pyrometer can be used to seek only this particular transition point on the poker.

The operation of the various actuators of the poking system, e.g. the hydraulic drive 28, the rail clamping device and the piston and cylinder devices 36, 52, 68 and **68*a***, are coordinated by an automatic control system in the manner described below.

Initially the poker 50 is mounted on the arm 30 so that the leading end of the poker is located at a preselected datum point relative to the arm 30. The clamp **60*a* is then operated (conveniently by means of a manually accessible switch) to clamp the poker in the datum position. At this time, the clamp 60 will not be operative, the device 52 will be fully retracted and the device 36 will be set so that the arm 30** lies at a preselected inclination corresponding substantially to the inclination of the poke hole axes.

Means may be provided to signal arrival of the carriage 16 at a position in which it is in proper registry with each poke hole. Upon receipt of such a signal, the control equipment generates signals to interrupt the drive 28 and to operate the rail clamp so that the carriage 16 is then held stationary adjacent the poke hole through which the poker is to be inserted. Each poke hole may normally be closed by a valve flap or the like, as previously mentioned, and when a given poke hole is to be used, the control equipment conveniently operates an actuator (not shown) to open the valve and also operate a steam curtain producing device (which may, if desired, be carried by the carriage 16) which ejects steam into and/or across the poke hole to inhibit the escape of gases during the poking procedure.

To effect advance of the poker 50, the device 52 is first extended with the clamp 60 still inoperative and when the extension stroke has been completed, clamp 60 is operated, clamp 60*a* is disabled leaving the poker free to move with the slide, and the slide 38 is advanced forwardly by retracting the device 52 thereby advancing the poker into the poke hole by a distance corresponding to one stroke of device 52. Upon completion of the retraction stroke, clamp 60 is disengaged, clamp 60*a* is operated and the slide 38 is withdrawn rearwardly by extending the device 52 while the poker remains clamped to the arm 30. The above procedure is then repeated and it will be understood that the poker is advanced into the gasifier in steps corresponding to the retracting stroke of the device 52. The number of strokes executed by the device 52 is monitored by the control equipment and this information together with the pulse output from the pickup 56 enables the control equipment to monitor the position of the poker.

Advance of the poker in this way is continued until the poker has been advanced through a predetermined distance, e.g. until its leading end is in close proximity to the grate 14. The poker is left in this position for a predetermined interval of time to allow it to approach thermal equilibrium with the contents of the gasifier. After this time period has expired, the poker is withdrawn incrementally by the slide 38 operating in a similar fashion to that previously described except that the clamp 60 is operated during extension of the device 52 and disengaged when the latter retracts. Again the exact position of the poker at any instant can be monitored by the control equipment according to the number of withdrawal strokes executed and the pulsed output of the pickup 56.

As the hot poker is withdrawn, it traverses the radiation sensitive element of the pyrometer 72 thus enabling the control equipment to determine the transition points corresponding to the upper and lower limits of the oxidation zone in the gasifier. The pyrometer is located in a known position relative to the datum point so that, from the poker position information derived by the control equipment, the physical location of the transition points on the poker can be determined by the control equipment. This, in turn, enables the positions of the upper and lower limits of the oxidation zone to be determined by the virtue of the fact that the poker is inserted through a known distance into the gasifier.

After the poker has been withdrawn at least until its leading end is clear of the contents of the gasifier, the poking operation may be repeated one or more times but with the poker inclined at a different attitude, as dictated by the device 36. During these further poking operations, further measurements of the oxidation zone levels may be obtained and because these further measurements are obtained at different inclinations of the poker, any tilting of the oxidation zone levels may be detected. Upon completion of servicing of the given poke hole, the poker is withdrawn by the slide 38 until its leading end reaches the datum position. The clamp 60*a* is then engaged, the steam curtain is shut-down, the valve flap is closed, the rail clamp for the carriage is released and the drive 28 is rendered operational to advance the carriage to the next poke hole to be serviced. The control equipment is conveniently programmed so that all of the above described operations take place automatically and the sequence in which the poke holes are serviced may be preprogrammed and may not necessarily take place in the sequence that they occur around the gasifier.

If during a poking operation, the poker encounters undue resistance to further advance, for example through the presence of clinker formation, this can be detected by the control equipment because increased pressure will be sensed by the pressure sensor 53 associated with the device 52. In this event, the control equipment may be programmed to place the slide 38 in a limited reciprocating mode in which the clamp 60 remains engaged while the slide 38 advances and retracts over a limited reciprocating stroke. In this way, a providing action is exerted by the poker on the obstruction. The position about which this limited reciprocating movement of the slide 38 occurs is progressively shifted as the obstruction breaks down and when the resistance to poker advance falls below a predetermined level, normal operation of the slide 38 may be resumed.

Over the course of a number of hours, the measurements made of the levels of the oxidation zone enable its depth and location to be ascertained and, if it is found that these measurements depart from the optimum measurements, the control equipment may operate automatically to regulate the rate of ash removal.

Although the invention is described above in terms of a single carriage for servicing the gasifier, there may be more than one carriage per gasifier; for example there may be two carriages each servicing the poke holes over one half of the gasifier periphery. It will be observed that the existing poke holes of the gasifier can be used without modification and a single poker can be used to service more than one poke hole and possibly all the poke holes of the gasifier. The poker may be of conventional design and its mounting on the carriage enables it to be removed easily (i.e. simply by disengaging both clamps 60 and 60*a*) for the purpose of renewing it or correcting any distortion that may occur due to the high internal temperatures it is subjected to in the gasifier. It will be observed that the monitoring of the position of the gasifier oxidation zone and the resistance encountered by the poker during insertion is effected without the need for physically connecting position sensing and force sensing transducers to the poker. In addition, location of the transition points on the poker corresponding to the limits of the oxidation zone is achieved without modifying the poker to incorporate thermocouples or such like which would then have to be subjected to the high temperatures within the gasifier. In the described embodiment of the invention, the temperature sensor is located externally of the gasifier at all times.

Figure 6:
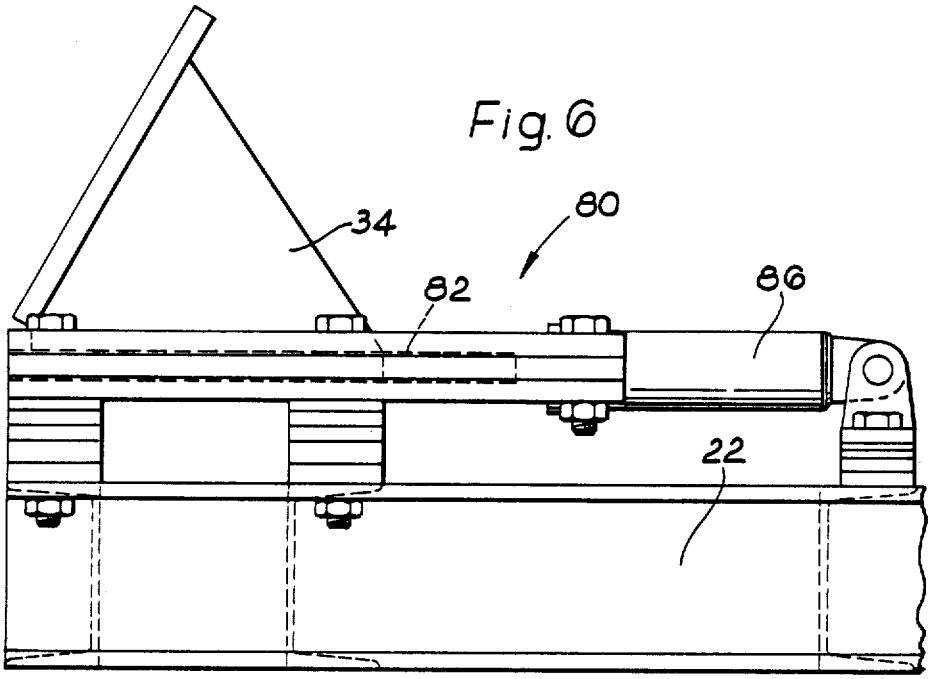
FIG. 6 is a side view of part of a modified form of carriage in accordance with the invention.
Figure 7:
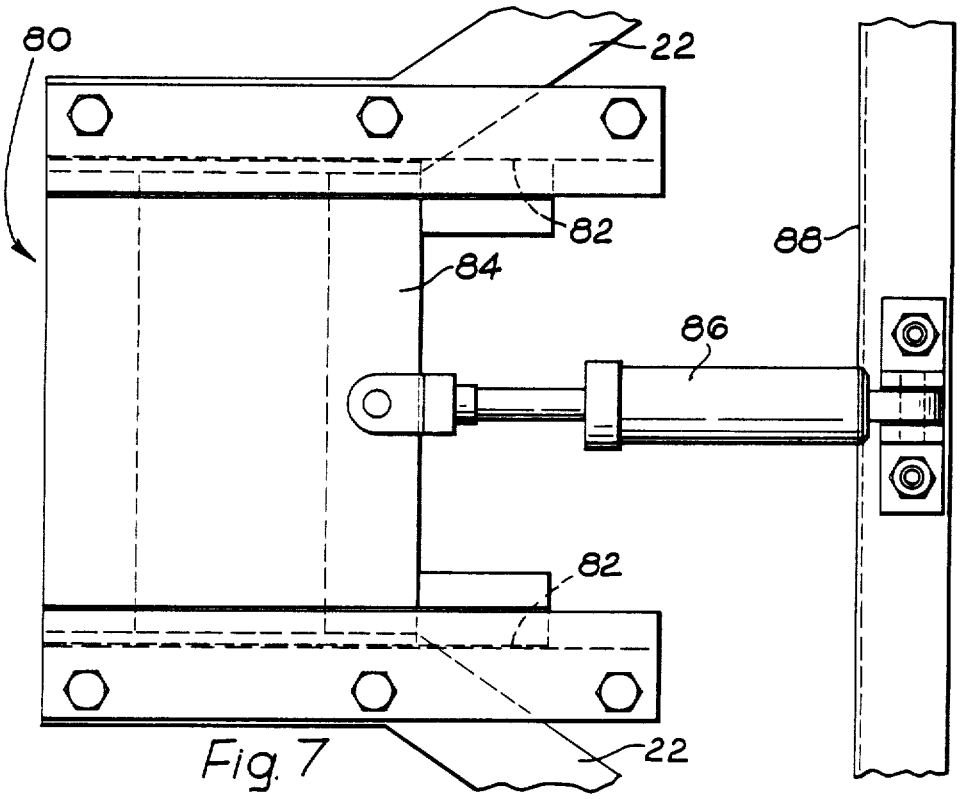
FIG. 7 is a plan view of the modification.

FIGS. 6 and 7 of the drawings illustrate a modification in which the bracket 34 is mounted on the carriage 22 through the agency of a slide structure 80 which enables the poker assembly 24 to be displaced radially inwardly and outwardly relative to the gasifier thereby facilitating proper registry of the poker with each pokehole even if the path of travel of the carriage and the circular arrangement of the pokeholes are not truly concentric. The slide structure 80 comprises a pair of slideways 82 secured to the carriage structure, a sliding plate 84, which carries the bracket 34 and slidably engages with the slideways 82, and a hydraulic ram 86 acting between the plate 84 and a cross member 88 of the carriage structure. It will be observed that extension and retraction of the ram 86 is effective to cause radial displacement of the bracket 34 and hence the pokerod assembly as a whole. In practice, the degree of radial shift required to compensate for any departure from true concentricity is relatively small and consequently the extent of sliding movement involved is likewise small. An important advantage resulting from this modification is that retrofitting of the pokerod assembly to an existing gasifier is simplified as any deviation of the pokeholes from a truly circular distribution is readily compensated for.

Having now described by invention what I claim is:

1. Apparatus for sensing temperature within the interior of a gasifier, said apparatus comprising a rod, means for advancing and retracting the rod into and out of the gasifier, means for sensing the position of the rod with respect to a datum position at least during withdrawal of the rod and a temperature sensor disposed externally of the interior of the gasifier adjacent the path of travel of the rod for sensing the temperature of the rod along its length as the rod is withdrawn from the gasifier whereby the positions and temperatures sensed by said position-sensing means and said temperature sensor respectively can be combined to provide an indirect indication of the location of one or more temperature-transition zones within that region of the gasifier from which the rod is withdrawn.

2. Apparatus as claimed in claim 1 in which the temperature sensor is constituted by a pyroelectric device providing an electrical output representing the radiation sensed.

3. Apparatus as claimed in claim 2 in which the pyroelectric device is associated with a threshold detector to determine whether the electrical output of the device is above or below a predetermined value corresponding to the radiation level emitted by that portion of the rod which, prior to withdrawal, has been exposed to and has approached thermal equilibrium with the oxidation zone of the gasifier.

4. Apparatus as claimed in claim 1 including means for adjusting the angle of entry and withdrawal of the rod into and out of the gasifier.

5. Apparatus as claimed in claim 1 in which the rod, said advancing and retracting means and the temperature sensor are all mounted on a mobile carriage which, in turn, is mounted on a track extending about the gasifier.

6. Apparatus as claimed in claim 5 in which said rod, and said advancing and retracting means are all mounted on the carriage through the agency of a slide structure provided with means for adjusting the slide structure relative to the carriage inwardly and outwardly with respect to the gasifier.

7. Apparatus as claimed in claim 1 in which said rod-advancing and retracting means comprises a reciprocating device and means for selectively coupling the rod to the reciprocating device during strokes of the latter in one direction or during strokes of the latter in the opposition direction whereby the rod is either advanced incrementally into the gasifier or retracted incrementally from the gasifier.

8. Apparatus as claimed in claim 7 in which said coupling means is further operable selectively to couple the rod to the reciprocating device during both strokes of the latter whereby the rod can be reciprocated back and forth in order to agitate the contents of the gasifier.

9. Apparatus as claimed in claim 8 in which said reciprocating device comprises a fluid-powered piston and cylinder assembly and further includes a pressure sensor associated with said cylinder to sense the fluid pressure therein and thereby provide a measure of the force applied to the rod by the reciprocating device, said coupling means being operable to couple the rod to the reciprocating device during both strokes of the latter when said pressure sensor indicates that the applied force exceeds a predetermined value.

* * * * *